United States Patent [19]

Okano

[11] 4,187,670

[45] Feb. 12, 1980

[54] TIME SIGNAL GENERATOR CIRCUIT FOR USE IN AN ELECTRONIC TIMEPIECE

[75] Inventor: Yasunobu Okano, Tokyo, Japan

[73] Assignee: Nippon Electric Co., Ltd., Tokyo, Japan

[21] Appl. No.: 882,767

[22] Filed: Mar. 2, 1978

[30] Foreign Application Priority Data

Mar. 4, 1977 [JP] Japan ..... 52-23598

[51] Int. Cl.[2] ..... G04C 3/00; G04C 21/12; G04C 21/16; G08B 3/00

[52] U.S. Cl. ..... 58/23 R; 58/13; 58/38 R; 340/384 E

[58] Field of Search ..... 58/13, 14, 21.12, 23 R, 58/38 R, 39, 57.5, 152 B; 340/384 E

[56] References Cited

U.S. PATENT DOCUMENTS 4,104,865 8/1978 Sasaki ..... 340/384 E

*Primary Examiner*—Edith S. Jackmon

*Attorney, Agent, or Firm*—Hopgood, Calimafde, Kalil, Blaustein & Lieberman

[57] ABSTRACT

A time generator circuit comprises a reference signal generator and frequency divider circuits to divide the reference signal to generate a first signal at an audio frequency, an hour signal, and a plurality of third signals of different predetermined frequencies. The third signals are applied to a selecting circuit which selects one of these signals. An output generating circuit receives the first signal as an output time signal in response to the second signal during a time period determined by the selected one of the third signals.

8 Claims, 6 Drawing Figures

TIME SIGNAL GENERATOR CIRCUIT FOR USE IN AN ELECTRONIC TIMEPIECE

FIELD OF THE INVENTION

The present invention relates generally to electronic timepieces, and more particularly, to a time signal generator circuit for use in an electronic wrist watch.

DESCRIPTION OF THE PRIOR ART

In the known electronic timepieces in which a time signal is generated every hour or at a preset time, the time signal is generated by applying an audio frequency signal obtained by dividing a reference frequency into second, minute and hour signals to an audible tone generator such as a loudspeaker during a predetermined time duration from the time for generating the time signal. The predetermined time duration is defined by a pulse generated by a pulse generator. In order to change this time duration when the time signal is being generated, it has been proposed to vary the period of the pulse generated by the pulse generator, or to select by means of a switching means one of a plurality of pulse generators for generating a plurality of pulses of different periods. However, the former approach requires the use of either a variable capacitor and/or a variable resistor, and consequently the construction of this arrangement is inevitably large in size. The latter approach has a disadvantage that not only the circuit construction is complex but also a large number of capacitors and resistors are required and the construction is large in size similar to the former approach. Especially in a wrist watch, which includes an electric circuit formed as a semiconductor integrated circuit for the purpose of making it compact it is not practical to add any variable element to the circuit such as a variable resistor or a variable capacitor which would significantly increase the size of the circuit. Furthermore, in the latter approach described above the large number of resistors and/or capacitors needed to form a large number of pulse generators, and the transfer switch means for selecting one pulse from the pulse generators, are necessary as externally associated elements to the semiconductor integrated circuit, but it is not feasible to provide a plurality of such associated elements in view of the limited space available.

As a result of these disadvantages in the previously considered circuits, no electronic timepiece having a variable period during which a time signal is generated has been made commercially available.

It is an object of the present invention to provide a time signal generator circuit for use in an electronic timepiece in which the time duration when a time signal is being generated can be selected at various values.

It is a further object of the present invention to provide a time generator circuit of the type described which is simple to operate and which can be implemented in a relatively simple circuit construction.

SUMMARY OF THE INVENTION

The present invention provides a time signal generator circuit comprising a reference signal generator, a frequency divider circuit dividing the frequency of the reference signal and generating a first signal at an audio frequency, a second signal indicating an hour, and a plurality of third signals having different and predetermined frequencies. A selecting circuit receives the third signals and selects one of the third signals, and an output generating circuit receives the first signal as an output time signal in response to the second signal during a time period determined by the selected third signal. The time signal generator circuit of the invention, which finds utility in an electronic timepiece, may comprise an oscillator for generating a reference frequency signal, and a clock generator circuit for generating second, minute and hour signals by dividing the reference frequency. Means are provided for deriving an audio frequency signal from this clock generator circuit and for deriving a plurality of frequency-divided signals having different periods among the frequency-divided signals generated in the clock generator circuit. Means are further provided for detecting a preset time when a time signal is to be generated. The signal generator circuit also includes, in accordance to one embodiment, a plurality of selector means each having a common output terminal and an input terminal to which one of the plurality of frequency-divided signals having different periods is applied, and a ring counter having the same number of stages as the number of said plurality of frequency-divided signals having different periods. The outputs of the respective stages of the ring counter are applied to the plurality of selector means so that one of the plurality of selector means may transmit the signal applied to its input terminal to its output terminal. Means responsive to an output of the means for detecting a preset time for outputting a signal having a duration equal to one period of the frequency-divided signal obtained at the output terminal of selected selector means among the plurality of selector means, and the audio frequency signal is applied to a tone generator when an output of the signal outputting means having a duration equal to one period, is generated.

Since the change of the time duration when a time signal is generated can be effected by merely applying clock pulse signals successively to the ring counter to change its output stages successively, the number of the necessary transfer switches is only one. Also, since the setting of the time duration is achieved by means of an output obtained by frequency-dividing a reference frequency signal, no capacitive element is required in the signal generator circuit of the invention. In addition, since the construction of the remaining circuit portions are formed of digital processing circuits which do not necessitate any capacitive element, the entire circuit can be constructed in one semiconductor chip. Consequently, the circuit of the invention can be constructed in the form of a semiconductor integrated circuit, so that the circuit can be made compact and small such that it is highly suitable for use in an electronic wrist watch.

The above and other objects and features of the invention will become apparent from the following description taken in conjunction with the accompanying drawings, wherein:

DESCRIPTION OF THE PREFERRED EMBODIMENTS

Figure 1:
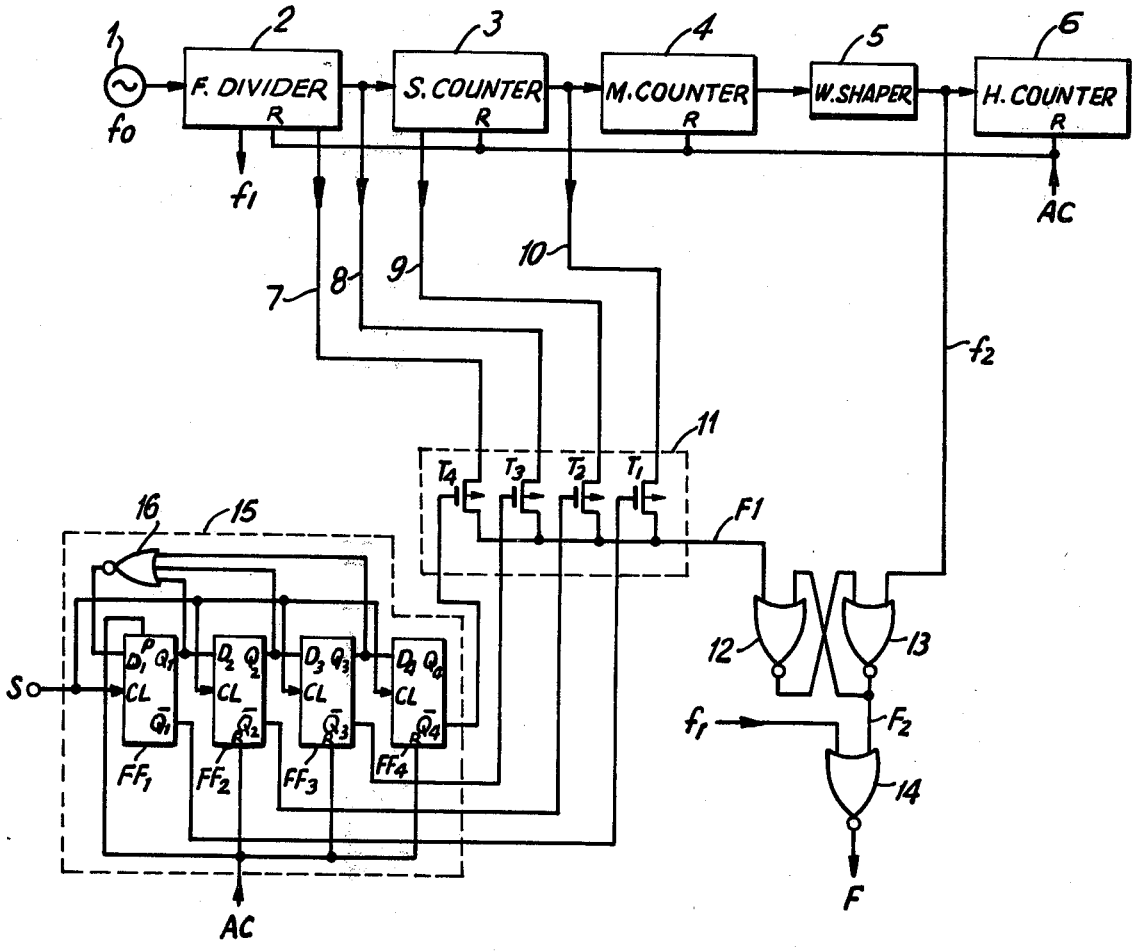
FIG. 1 is a circuit diagram of a signal generating circuit according to one embodiment of the present invention.

In the embodiment of the present invention illustrated in FIG. 1, a signal having a reference frequency $f_0$ (=32.768 KHz) is generated, by means of an oscillator circuit 1 containing, for example, a crystal oscillator, and this signal is frequency-divided by a frequency-divider circuit 2 to produce a signal of 1 Hz. One of the frequency-divided outputs produced in the process of frequency-division in the frequency-divider 2 and having an audio frequency, is selected to be used as a signal $f_1$ for time signalling in a timepiece. In the illustrated embodiment, a signal having a frequency $f_1 = 1024$ Hz is employed as the time signal. Subsequently, the 1 Hz signal is inputted to time counters 3 and 4 for counting seconds and minutes, respectively, and the counts of the counters 3 and 4 are transmitted as is conventional to a display device (not shown) via decoders (also not shown) to drive the display device so as to effect a display of the seconds and the minutes. The output of the minute counter 4 is shaped by means of a waveform shaper circuit 5 to produce a pulse signal $f_2$ which is generated at a rate of once per 3600 signal pulses of 1 Hz, that is, once an hour. This signal $f_2$, which is a signal representing an "hour", is applied to an hour counter 6 in the next stage, and an hour display device (not shown) is driven by the output of hour counter 6 via a decoder also (not shown).

The signal generator circuit of FIG. 1 includes means for providing signals for defining the time duration of the time signal. More particularly, as therein shown, a 2 Hz signal 7 derived from an intermediate frequency-dividing stage in the frequency-divider circuit 2, a 1 Hz signal 8 derived from the output of the frequency-divider circuit 2, a 0.5 Hz signal 9 derived from an intermediate frequency-dividing stage in the second counter circuit 3, and a 1/60 Hz signal 10 derived from the output of the second counter circuit 3, are respectively introduced to the inputs of a gate circuit 11, which forms a signal selector circuit. The gate circuit 11 selects a signal $F_1$ from the signals 7 to 10, and signal $F_1$ is applied to one input of a 2-input NOR circuit 12, which forms an R-S flip-flop with another 2-input NOR circuit 13. The signal $f_2$ representing an "hour" is applied to one input of another 2-input NOR circuit 13, the output of which is in turn applied to the other input of the NOR circuit 12. The output of the NOR circuit 12 is applied to the other input of the NOR circuit 13, and the output $F_2$ of the NOR circuit 13 is applied to one input of a 2-input NOR circuit 14. The signal $f_1$ is applied to the other input of the NOR circuit 14 for time signalling. Generation of a time signal is effected by the output F of the NOR circuit 14.

The gate circuit 11 may be constructed, as shown, of P-channel enhancement type MOS transistors $T_1$ to $T_4$. Signals 10, 9, 8, and 7 are respectively applied to either the sources or the drains of transistors $T_1$ to $T_4$ and the other of the sources or drains of transistors $T_1$ to $T_4$ are connected in common to generate the output signal $F_1$. Control signals from a control signal generator 15 are applied to the gates of transistors $T_1$ to $T_4$ circuit 15 forming a selector circuit jointly with the gate circuit 11.

The control signal generator circuit 15 may consist of, for example, D-type flip-flops $FF_1$ to $FF_4$ and a NOR circuit 16 which form a ring counter, as illustrated in FIG. 1. An output $Q_1$ of the flip-flop $FF_1$ is applied to a data input $D_2$ of the flip-flop $FF_2$, an output $Q_2$ of the flip-flop $FF_2$ is applied to a data input $D_3$ of the flip-flop $FF_3$, and an output $Q_3$ of the flip-flop $FF_3$ is applied to a data input $D_4$ of the flip-flop $FF_4$. In addition, the respective outputs $Q_1$, $Q_2$ and $Q_3$ of the flip-flops $FF_1$, $FF_2$ and $FF_3$ are applied to the inputs of a 3-input NOR circuit 16, whose output is applied to the data input $D_1$ of the flip-flop $FF_1$. Outputs $\overline{Q}_1$, $\overline{Q}_2$, $\overline{Q}_3$ and $\overline{Q}_4$ of the respective flip-flops $FF_1$, $FF_2$, $FF_3$ and $FF_4$ respectively serve as gate inputs of the transistors $T_1$, $T_2$, $T_3$ and $T_4$. A clock pulse signal S is applied to the clock inputs CL of the flip-flops $FF_1$ to $FF_4$ such as by means of a push botton switch or the like, so that each time the push-button switch is depressed, a clock pulse signal S at a high level is applied to the clock inputs CL of the flip-flops $FF_1$ to $FF_4$ to transfer a high level output at the one of the outputs $Q_1$ to $Q_4$ of the flip-flops $FF_1$ to $FF_4$ successively to the flip-flop in the next stage of the counter.

In addition, a reset signal AC is applied to the reset terminals of the frequency-divider circuit 2, time counter circuits 3 and 4, and flip-flops $FF_2$, $FF_3$ and $FF_4$, and also to a preset terminal P of the flip-flop $FF_1$.

Figure 2A:
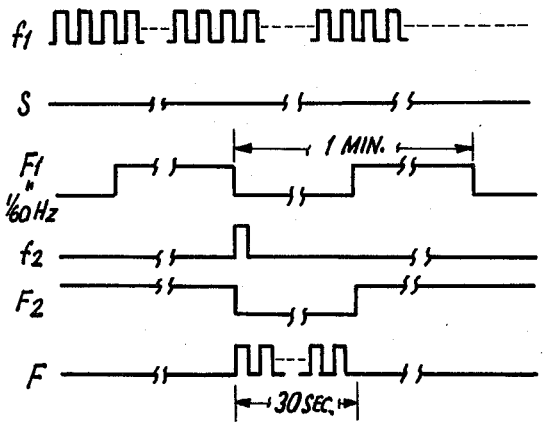
FIGS. 2 (*a*) to 2 (*d*) are pulse timing diagrams for illustrating the operation of the embodiment shown in FIG. 1.
Figure 2:
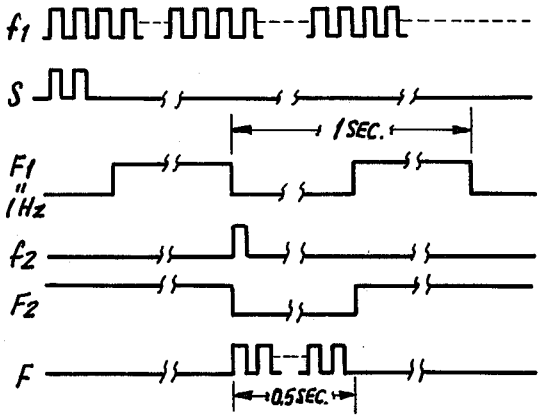
Figure 2B:
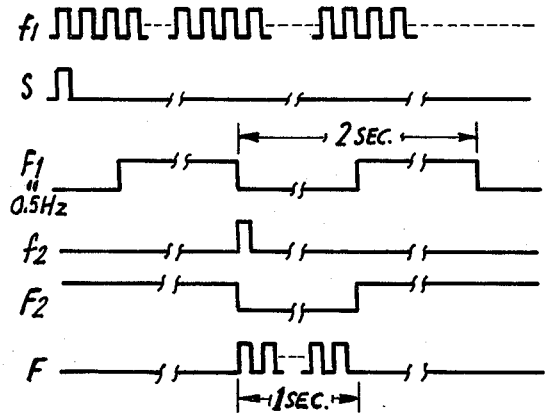
Figure 2D:
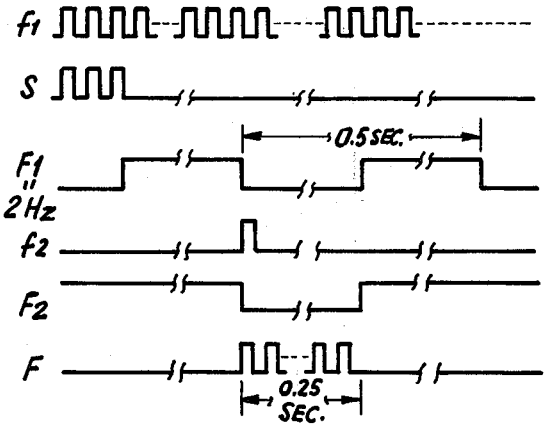

The operations of the circuit shown in FIG. 1 are now described with reference to the pulse timing diagrams of FIGS. 2(*a*) to 2(*d*). Upon switching on a power source, the frequency-divider circuit 2, time counter circuits 3, 4 and 6 and flip-flops $FF_2$, $FF_3$ and $FF_4$ are all reset by the reset signal AC by an additional circuit (not shown). Accordingly, the outputs $\overline{Q}_2$, $\overline{Q}_3$ and $\overline{Q}_4$ of the flip-flops $FF_2$, $FF_3$ and $FF_4$, respectively, are at a high level, so that the transistors $T_2$ to $T_4$ become non-conducting. On the other hand, the flip-flop $FF_1$ is preset so as to deliver a low level at its output $\overline{Q}_1$, and so, only the transistor $T_1$ of gate circuit 11 is conducting. In this state, if the push-button switch is not depressed, the signal 10 at a rate of 1/60 Hz is generated as the signal $F_1$ due to the conduction of the transistor $T_1$ as shown in FIG. 2(*a*). Therefore, the period of the signal $F_1$ is equal to one minute, and the repetition period of the pulses in the signal $f_2$ is equal to one hour. Accordingly, at each hourly time of the clock such as 1:00, 2:00, 3:00, . . . a pulse in the signal $f_2$ is inputted to the 2-input NOR circuit 13, and in response to this input pulse, a low level pulse signal $F_2$ having a duration (=30 seconds) equal to $\frac{1}{2}$ period of the signal $F_1$ (=1/60 Hz) is outputted from the NOR circuit 13. The signal $F_2$ and the signal $f_1$ (=1024 Hz) are inputted to the 2-input NOR circuit 14, and thereby the output signal F is outputted as a time signal as shown in FIG. 2(*a*). This implies that the 1024 Hz signal is outputted for 30 seconds as the time signal.

Next, if, as shown in FIG. 2(*b*), a high level signal S is inputted to the clock inputs CL of the four flip-flops $FF_1$ to $FF_4$ by depressing the push-button switch once for the purpose of changing the time duration of the time signal, then the output $\overline{Q}_2$ of the flip-flop $FF_2$ is turned to a low level, so that only the transistor $T_2$ becomes conducting in the gate circuit 11, the signal $F_1$ becomes a 0.5 Hz signal, and consequently, as an output signal for time signalling, the 1024 Hz signal is outputted for one second in response to the pulse signal $f_2$.

Thus it will be readily seen that by further depressing the push-button switch twice and three times in total, the output signal $F_1$ from the gate circuit 11 becomes a 1 Hz signal and a 2 Hz signal, respectively, as shown in FIGS. 2(*c*) and 2(*d*), and thereby the 1024 Hz signal is outputted for 0.5 seconds and 0.25 seconds, respectively, as the time signal, in response to the pulse signal $f_2$.

In this way, the time duration of a time signal can be selected at various values by simply depressing a pushbutton switch or the like. Accordingly, for the purpose of changing the time duration when a time signal is being generated, a satisfactory result can be obtained with only one switch, so that the time signal generator according to the above-described embodiment is especially suitable for a wrist watch in which the available space is limited. In addition, when the circuit is constructed in the form of a semiconductor integrated circuit, the number of externally associated elements can be reduced to a minimum. With regard to the externally associated elements, except for a single switch neither a capacitive element nor a resistive element which requires a a strictly correct resistance value and thus fine adjustment is needed in the circuit, so that the circuit arrangement is highly suitable for fabrication in a semiconductor integrated circuit. Furthermore, a small number of externally associated elements result in a reduction of the chip area of the semiconductor integrated circuit by electrode areas for connection to the associated elements. This also results in a compact and simple construction of an electronic timepiece itself, so that compactness and high reliability of an electronic timepiece can be realized.

Although in the above-described embodiment four signals 7 to 10 are used to determine the time duration of the time signal, the selection of a time duration of a time signal from more varieties of time durations is possible by arbitrarily deriving frequency-divided output signals from the intermediate stages in the frequency-divider circuit 2, second counter circuit 3, and minute counter circuit 4 and by providing the gate circuit transistors and flip-flops in the ring counter equal in number to the number of these signals. A ring counter different from the above-mentioned construction may also be used for the ring counter 15. For example, a twisted ring counter formed of J-K flip-flops or the like may be used.

Figure 3:
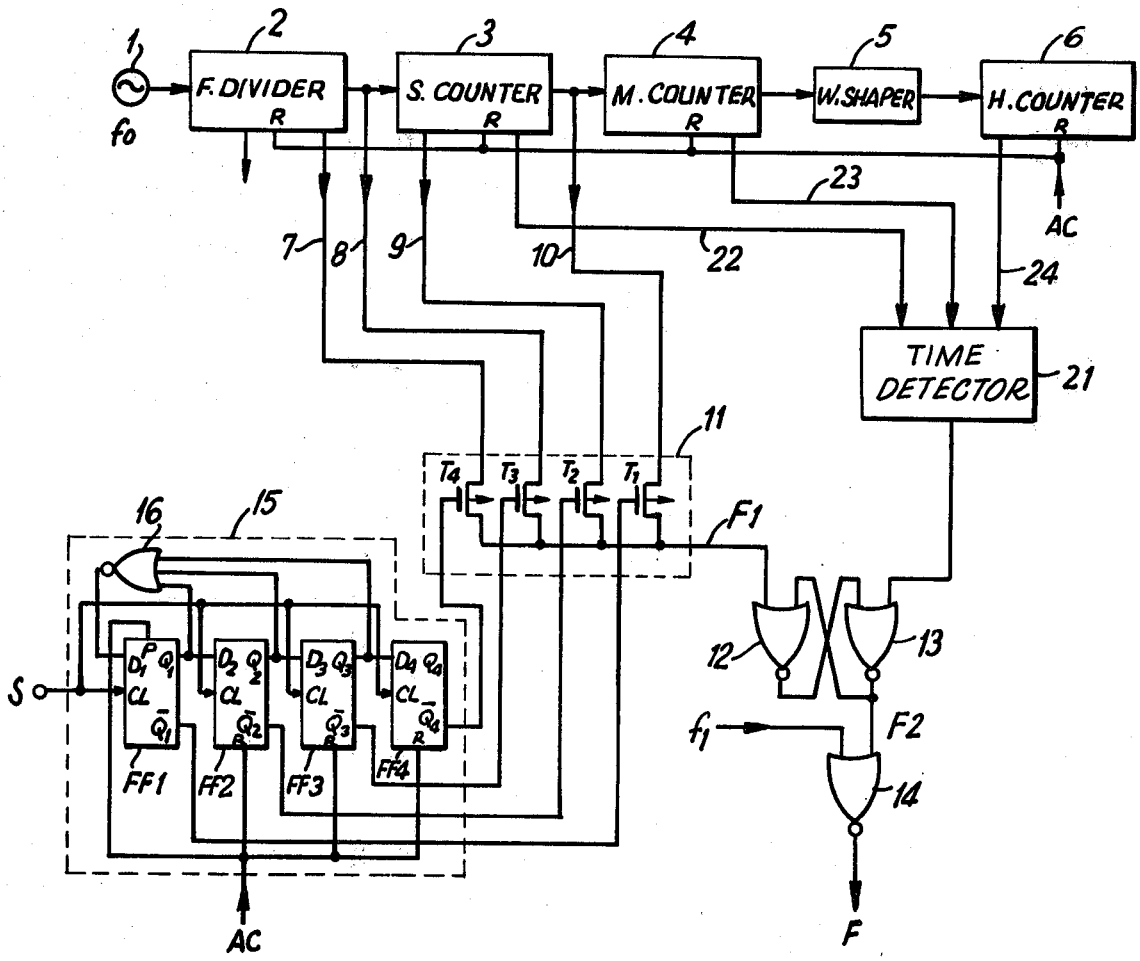
FIG. 3 is a circuit diagram of a signal generating circuit according to another embodiment of the present invention.

FIG. 3, illustrates another embodiment of the present invention in which an alarm is generated at a predetermined time not limited to just an hour. The basic difference between this modified embodiment and the above-described embodiment illustrated in FIG. 1 is the inclusion of a time detector circuit 21 to which signals are applied from the second counter 3, minute counter 4, and hour counter 6 and detecting the second, minute and hour of the predetermined time. The time detector circuit 21 may comprise, for instance, and AND circuit. In response to a time when each output of the second, minute and hour counters 3, 4 and 6 is at the respectively predetermined times, outputs appears on the lines 22, 23 and 24 which are led into the time detector circuit 21. When all the outputs appear on the lines 22, 23 and 24, the time detector circuit 21 derives an output, and an R-S flip-flop composed of 2-input NOR circuits 12 and 13 is set by that output and the signal $F_1$. With respect to the remaining construction and the operations, this modified embodiment of FIG. 3 is the same as that of the embodiment illustrated in FIG. 1.

The embodiment of FIG. 3 has the disadvantage that the circuit arrangement becomes somewhat complex due to the setting of a predetermined time, however, effects and advantages similar to those of the first embodiment illustrated in FIG. 1 can be expected.

It is to be noted that while the circuit of the invention has been described with a pushbutton switch used for selecting the desired time duration of a time signal, the selection of the time duration can be achieved in other ways, such as by introducing a pulse to the clock inputs CL of the flip-flops $FF_1$ to $FF_4$ instead of using the push-switch.

It will thus be appreciated that although the signal generator circuit of the present invention has been hereinabove described with respect to several embodiments thereof, variation to these embodiments may be made by those skilled in the art without necessarily departing from the spirit and scope of the invention.

What is claimed is:

1. A time signal generator circuit comprising:

an oscillator for generating a reference frequency signal;

means connected to said oscillator for frequency-dividing said reference frequency signal to generate electric signals, respectively, every second, every minute and every hour;

means for deriving an audio frequency signal by frequency-dividing said reference frequency signal;

means for deriving a plurality of time duration decision signals respectively having different predetermined periods among the signals obtained upon processing said reference frequency signals;

means for detecting a preset time when a time signal is to be generated;

a time duration switching circuit having a plurality of input terminals, a corresponding number of control terminals and an output terminal, said time duration decision signals being applied to said plurality of input terminals, one of said control terminals receiving a control signal for delivering at said output terminal said time duration decision signal applied to said input terminal associated with said one control terminal;

a ring counter consisting of a plurality of flip-flops cascaded with each other, said control signal being derived from one of the output terminals of said flip-flops, the output terminals of said flip-flops in said ring counter being connected, respectively, to said control terminals of said time duration switching circuit to thereby apply said control signals to said control terminals; and means for transmitting said audio frequency signal to an audible signal converter in response to the output of said means for detecting a preset time, during a time duration equal to the period of said time duration decision signal;

wherein said frequency-dividing means comprises a frequency-divider transforming said reference frequency signal into 1 $H_z$ signal, a second counter counting said 1 $H_z$ signal and deriving 1/60 $H_z$ signal, a minute counter counting said 1/60 $H_z$ signal and deriving 1/3600 $H_z$ signal, and an hour counter counting said 1/3600 $H_z$ signal; and wherein said means for transmitting said audio frequency signal to an audible signal converter comprises an R-S flip-flop having a set terminal connected to the output of said preset time detecting means and a reset terminal to which is operatively applied the output obtained at said output terminal of said time duration switching circuit, and means for applying said audio frequency signal to the audible signal converter during the time when said R-S flip-flop produces an output.

2. A time signal generator circuit comprising a reference signal generator, a frequency divider circuit connected to said reference signal generator for generating a first signal having an audio frequency, a second signal indicating an hour, and a plurality of third signals having different predetermined frequencies, a selecting circuit receiving said third signals and selecting one of said third signals, and an output generating circuit receiving said first signal, said second signal and the selected one of said third signals and passing said first signal as an output time signal in response to said second signal during a time period determined by said selected one of said third signals.

3. The time signal generator circuit of claim 2, further comprising a control circuit operatively connected to said selecting circuit and receiving a timing signal at its input and supplying a control signal to said selecting circuit to determine which of said third signals is selected.

4. The time signal generator circuit of claim 3, in which said selecting circuit comprises a plurality of switch means respectively receiving said third signals, said control signals being effective to selectively render one of said switch means conductive and to pass the selected one of said third signals to said output generating circuit.

5. The time signal generator circuit of claim 4, in which said control circuit comprises a plurality of binary stages arranged in cascade, each of said binary stages receiving said timing signal at an input thereof, the output of said binary stage being respectively operatively connected to the control terminal of said switching means in said selecting circuit.

6. The time signal generator circuit of claim 5, in which said cascaded binary stages of said control circuit comprise a plurality of flip-flops.

7. The time signal generator circuit of claim 4, in which said output generating circuit comprises first gating means receiving said second signal and the selected one of said third signals, and second gating means receiving the output of said first gating means and said first signal at its inputs.

8. The time signal generator of claim 7, in which said first gating means comprises a first NOR gate receiving the selected one of said third signals at one input, and a second NOR gate receiving said second signal at one of its inputs, the output of said second NOR gate being applied to the other input of said first NOR gate, and the output of said first NOR gate being applied to the other input of said second NOR gate, said second gating means comprising a third NOR gate receiving the output of said second NOR gate at one of its inputs and said first signal at the other of its inputs.

* * * * *